US010722774B2

(12) United States Patent
Creech

(10) Patent No.: US 10,722,774 B2
(45) Date of Patent: Jul. 28, 2020

(54) YOUTH FOOTBALL SLED ASSEMBLY

(71) Applicant: Travis Creech, Columbia, SC (US)

(72) Inventor: Travis Creech, Columbia, SC (US)

( * ) Notice: Subject to any disclaimer, the term of this patent is extended or adjusted under 35 U.S.C. 154(b) by 0 days.

(21) Appl. No.: 16/115,147

(22) Filed: Aug. 28, 2018

(65) Prior Publication Data

US 2020/0070029 A1 Mar. 5, 2020

(51) Int. Cl.
*A63B 69/34* (2006.01)

(52) U.S. Cl.
CPC ..... *A63B 69/345* (2013.01)

(58) Field of Classification Search
CPC ..... A63B 69/345; A63B 69/34; A63B 21/06; A63B 21/4047; A63B 21/4005; A63B 69/002; A63B 23/047; A63B 21/4001; A63B 21/0615
USPC ..... 473/444, 445, 438, 441, 443; D21/673, D21/686, 421, 698, 771, 788, 798; 482/83–89, 121, 129, 139, 90–95, 112
See application file for complete search history.

(56) References Cited

U.S. PATENT DOCUMENTS 3,062,548 A 11/1962 Foster
3,438,642 A * 4/1969 Puleo ..... A63G 25/00 280/8
D233,219 S * 10/1974 O'Donnell ..... D10/83
3,907,291 A 9/1975 Parker
4,005,859 A * 2/1977 Tait ..... A63C 3/00 482/66
4,021,033 A * 5/1977 Auclair ..... A63B 69/0022 482/66
4,140,315 A * 2/1979 Page, Jr. ..... A63B 21/0615 473/445
4,219,207 A * 8/1980 Muir ..... B62B 13/12 188/8
4,294,457 A * 10/1981 Thiboutot ..... A47C 4/286 280/20
5,090,696 A * 2/1992 Forrest, Sr. ..... A63B 69/345 473/444
6,257,599 B1 * 7/2001 Johnson ..... B62B 15/00 280/28
6,261,194 B1 7/2001 Hadar
D466,963 S * 12/2002 Forrest ..... D21/788
D469,142 S * 1/2003 Forrest ..... D21/788
6,761,650 B1 * 7/2004 Dettmann ..... A63B 69/345 473/441
6,942,585 B1 9/2005 Krause
6,988,965 B2 * 1/2006 Krause ..... A63B 69/345 473/441
7,322,893 B2 * 1/2008 Bright ..... A63B 69/345 473/441
D606,611 S * 12/2009 Rogers ..... D21/698
(Continued)

FOREIGN PATENT DOCUMENTS

WO WO2012123427 9/2012

*Primary Examiner* — Mitra Aryanpour

(57) ABSTRACT

A youth football sled assembly for training youth in American football tackling and blocking includes a sled that is positioned on a training field. The sled is comprised of tubular members such that the sled has no sharp edges to enhance safety for youth employing the sled for training American football tackling and blocking. A cushion is removably positioned on the sled and the cushion is pushed against by the youth during training. A plurality of weights is each selectively positioned on the sled for increasing a weight of the sled.

6 Claims, 4 Drawing Sheets

(56) References Cited

U.S. PATENT DOCUMENTS

| | | | | |
|---|---|---|---|---|
| 8,002,649 | B2 * | 8/2011 | Forrest, Sr. | A63B 69/002 473/445 |
| D659,779 | S | 5/2012 | Gray | |
| 8,328,664 | B2 | 12/2012 | Krause | |
| D684,641 | S * | 6/2013 | Jameson | D12/130 |
| 8,960,678 | B2 * | 2/2015 | Gilman | A63B 69/345 473/445 |
| 8,986,172 | B2 * | 3/2015 | Poole | A63B 21/0552 473/441 |
| 9,017,189 | B2 * | 4/2015 | Leath | A63B 21/012 473/422 |
| D831,760 | S * | 10/2018 | Safranka | D21/686 |
| 2006/0035734 | A1 | 2/2006 | Borunda | |
| 2010/0203986 | A1 * | 8/2010 | Gilman | A63B 21/06 473/445 |
| 2011/0177891 | A1 * | 7/2011 | Gilman | A63B 21/0615 473/441 |
| 2011/0224051 | A1 * | 9/2011 | Larish | A63B 21/012 482/93 |

* cited by examiner

YOUTH FOOTBALL SLED ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to sled devices and more particularly pertains to a new sled device for training youth in American football tackling and blocking.

BRIEF SUMMARY OF THE INVENTION

An embodiment of the disclosure meets the needs presented above by generally comprising a sled that is positioned on a training field. The sled is comprised of tubular members such that the sled has no sharp edges to enhance safety for youth employing the sled for training American football tackling and blocking. A cushion is removably positioned on the sled and the cushion is pushed against by the youth during training. A plurality of weights is each selectively positioned on the sled for increasing a weight of the sled.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
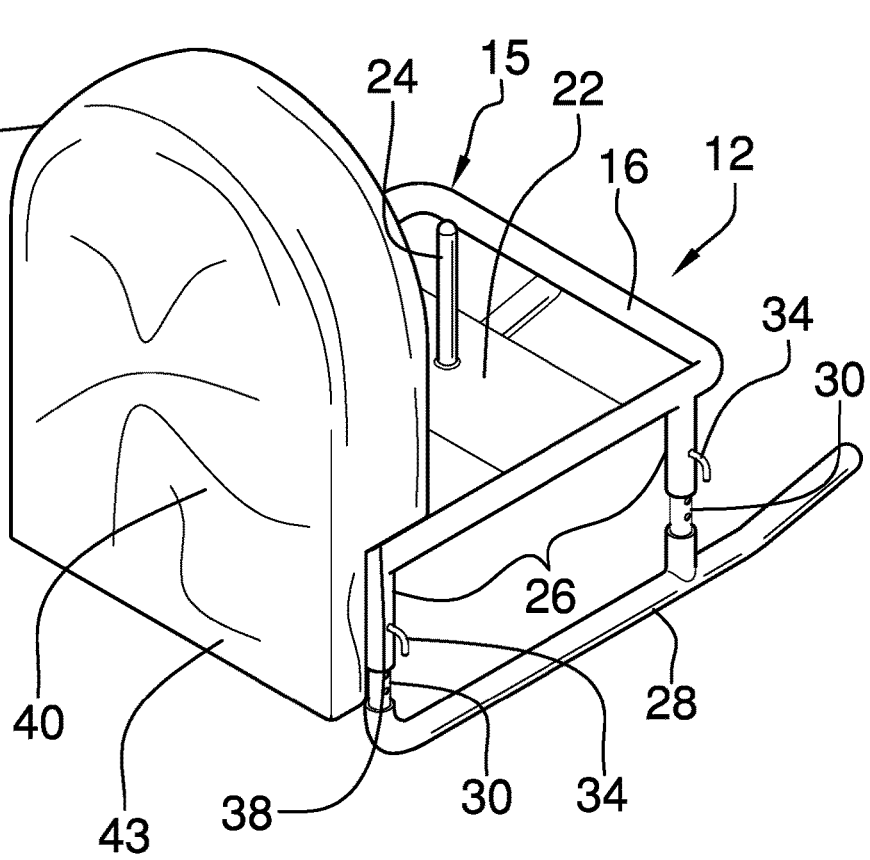
FIG. 1 is a front perspective view of a youth football sled assembly according to an embodiment of the disclosure.
Figure 2:
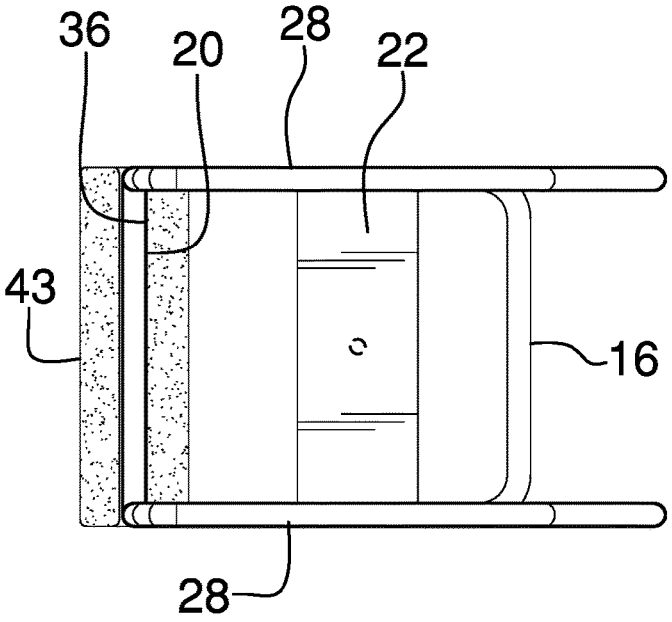
FIG. 2 is a bottom view of an embodiment of the disclosure.
Figure 3:
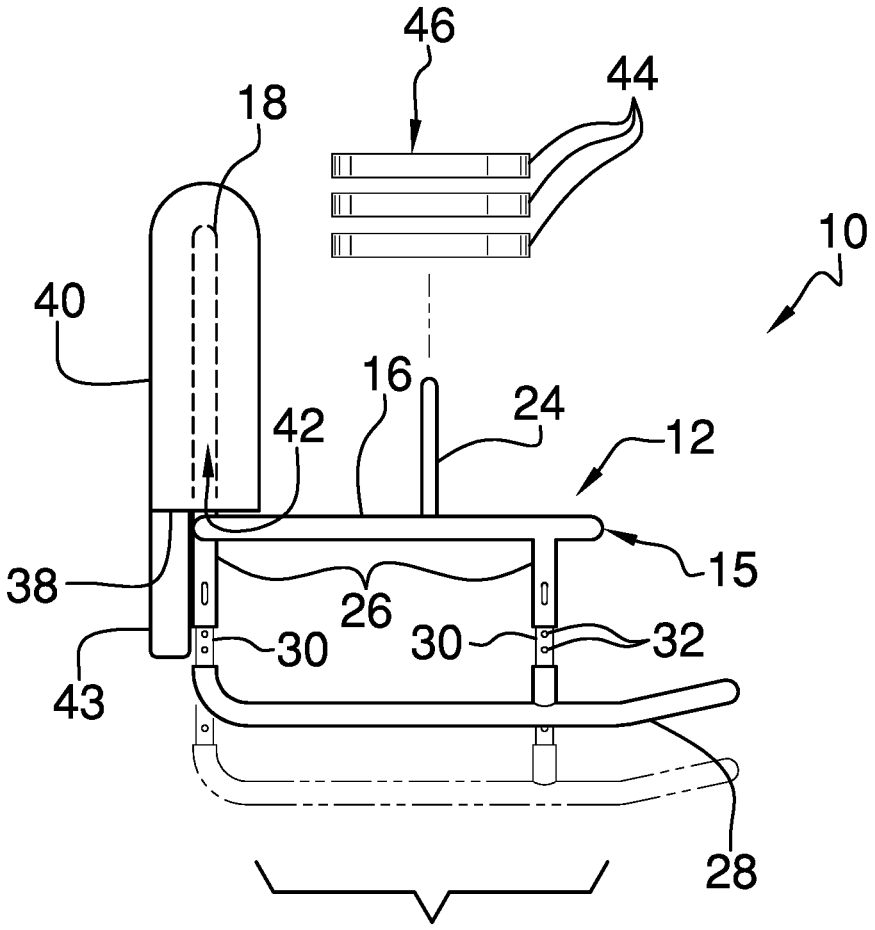
FIG. 3 is a left side phantom view of an embodiment of the disclosure.
Figure 4:
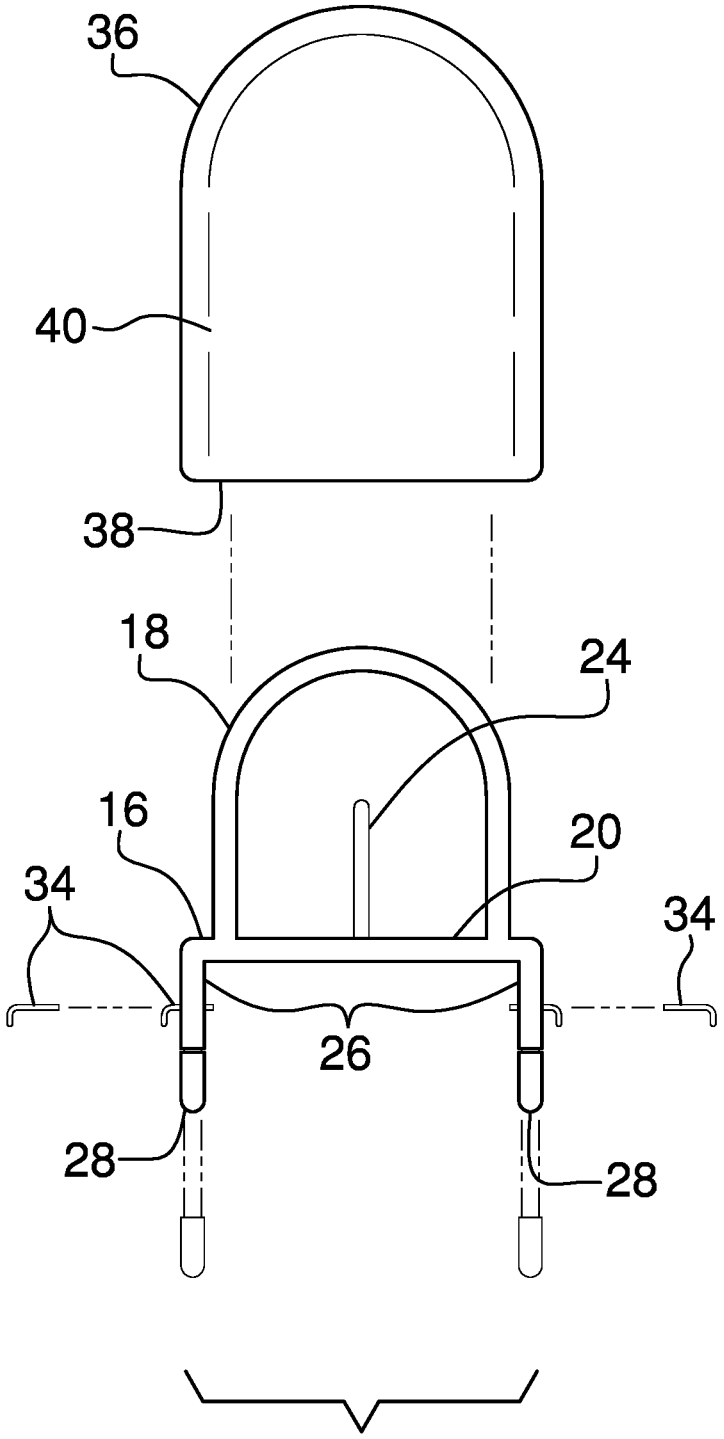
FIG. 4 is a front exploded view of an embodiment of the disclosure.
Figure 5:
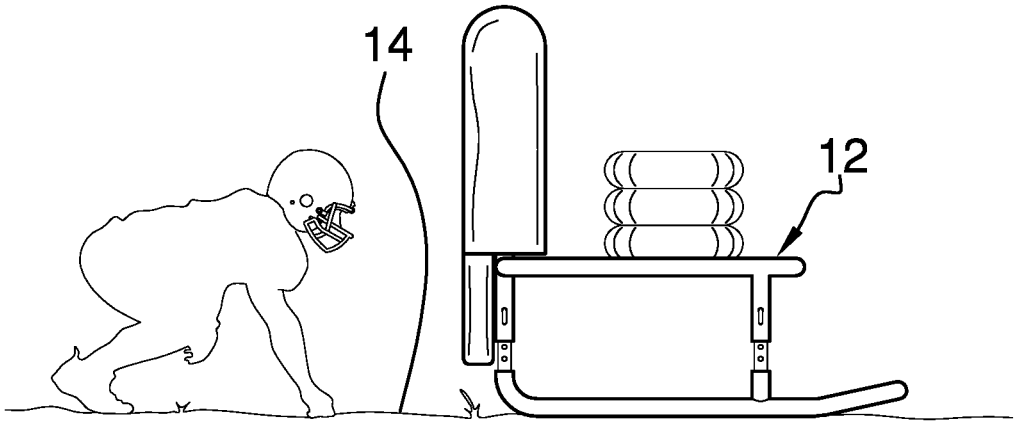
FIG. 5 is a perspective in-use view of an embodiment of the disclosure.

With reference now to the drawings, and in particular to FIGS. 1 through 5 thereof, a new sled device embodying the principles and concepts of an embodiment of the disclosure and generally designated by the reference numeral 10 will be described.

As best illustrated in FIGS. 1 through 5, the youth football sled assembly 10 generally comprises a sled 12 that is positioned on a training field 14. The sled 12 is comprised of tubular members such that the sled 12 has no sharp edges. Thus, the sled 12 enhances safety for youth employing the sled 12 for training American football tackling and blocking. Additionally, the sled 12 is smaller than existing tackling sleds thereby facilitating youth to train with the sled 12.

The sled 12 comprises a frame 15 that has a box portion 16 and an arch portion 18 that is oriented perpendicular to and extends upwardly from the box portion 16. The box portion 16 has a forward member 20 and the arch portion 18 is positioned on the forward member 20. A support 22 extends laterally across the box portion 16 and the support 22 is spaced from the arch portion 18. A rod 24 is coupled to and extends upwardly from the support 22. The box portion 16 may have padding attached thereto and facing outwardly thereform to protect the youth from impact injury when the youth strike the box portion 16.

A plurality of tubes 26 is each coupled to and extends downwardly from the box portion 16 of the sled 12. Each of the tubes 26 is aligned with a respective one of four corners of the box portion 16. A pair of rails 28 is provided and each of the rails 28 has a pair of stems 30 each extending upwardly therefrom. Each of the tubes 26 insertably receives a respective one of the stems 30 on a respective one of the rails 28. Thus, the rails 28 slide along the training field 14 when the sled 12 is pushed against. Each of the stems 30 has a plurality of apertures 32 therein that are vertically distributed thereon.

A plurality of pins 34 is provided and each of the pins 34 is extendable through a respective one of the tubes 26. Each of the pins 34 engages a selected one of the apertures 32 in the respective stem 30 that is positioned in the respective tube 26. In this way that frame 15 can be positioned at a selectable height on the rails 28. The sled 12 may be positionable at a height ranging between approximately 15.0 cm and 45.0 cm.

A cushion 36 is provided and the cushion 36 is removably positioned on the sled 12. Thus, the cushion 36 is pushed against by the youth during training. The cushion 36 has a bottom side 38 and a front side 40, and the bottom side 38 has a well 42 extending upwardly therein. The arch portion 18 of the frame 15 extends upwardly in the well 42 when the cushion 36 is positioned on the sled 12. The front side 40 is exposed and the front side 40 is pushed against by the youth. Thus, the cushion 36 protects the youth from impact injury during training. A pad 43 is coupled to and extends downwardly from the bottom side 38 of the cushion 36 and the pad 43 is aligned with the front side 40 of the cushion 36. The pad 43 is covers each of the tubes 26 that are positioned adjacent to the arch portion 18 thereby inhibiting the youth from striking the tubes 26 adjacent to the arch portion 18.

A plurality of weights 44 is provided and each of the weights 44 is selectively positioned on the sled 12 for increasing a weight of the sled 12 wherein the sled 12 is configured to pose increased resistance to the youth during training. Each of the weights 44 has an aperture 46 extending therethrough and the rod 24 extends through the aperture 46 in each of the weights 44 when each of the weights 44 is positioned on the sled 12. The weights 44 may be plates for strength training equipment thereby facilitating plates in a gym to be used on the sled 12. Additionally, the weights may be tires or any other rounded, weighted material.

In use, the frame 15 is positioned at the selected height on the rails 28 and each of the pins 34 is extended through the respective tube 26 to retain the frame 15 at the selected height. A selected number of the weights 44 are positioned on the rod 24 for increasing the effort required to slide the sled 12 on the training field 14. The tubular construction of the sled 12, along with the height at which the frame 15 can be positioned, facilitates youth to employ the sled 12 for training American football tackling and blocking.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A youth football sled assembly being configured to train youth in American football tackling and blocking, said assembly comprising:

a sled being positioned on a training field, said sled being comprised of tubular members each having a circular cross-sectional shape, wherein said sled is configured to enhance safety for youth employing said sled for training American football tackling and blocking;

a frame having a box portion and an arch portion being oriented perpendicular to and extending upwardly from said box portion, said box portion having a forward member, said arch portion being positioned on said forward member;

a support extending laterally across said box portion, said support being spaced from said arch portion; and a rod being coupled to and extending upwardly from said support;

a plurality of tubes, each of said tubes being coupled to and extending downwardly from said box portion, each of said tubes being aligned with a respective one of four corners of said box portion;

a cushion being removably positioned on said sled wherein said cushion is configured to be pushed against by the youth during training; and a plurality of weights, each of said weights being selectively positioned on said sled for increasing a weight of said sled wherein said sled is configured to pose increased resistance to the youth during training.

2. The assembly according to claim 1, wherein said sled further comprises:

a pair of rails, each of said rails having a pair of stems each extending upwardly therefrom, each of said tubes insertably receiving a respective one of said stems on a respective one of said rails wherein each of said rails is configured to slide along the training field, each of said stems having a plurality of apertures therein being vertically distributed thereon.

3. The assembly according to claim 2, further comprising a plurality of pins, each of said pins being extendable through a respective one of said tubes, each of said pins engaging a selected one of said apertures in said respective stem that is positioned in said respective tube such that sled is positioned at a selectable height on said rails.

4. The assembly according to claim 1, wherein said cushion has a bottom side and a front side, said bottom side having a well extending upwardly therein, said arch portion of said frame extending upwardly in said well when said cushion is positioned on said sled having said front side being exposed wherein said front side is configured to be pushed against by the youth.

5. The assembly according to claim 1, wherein each of said weights has an aperture extending therethrough, said rod extending through said aperture in each of said weights when each of said weights is positioned on said sled.

6. A youth football sled assembly being configured to train youth in American football tackling and blocking, said assembly comprising:

a sled being positioned on a training field, said sled being comprised of tubular members each having a circular cross-sectional shape, wherein said sled is configured to enhance safety for youth employing said sled for training American football tackling and blocking, said sled comprising:

a frame having a box portion and an arch portion being oriented perpendicular to and extending upwardly from said box portion, said box portion having a forward member, said arch portion being positioned on said forward member;

a support extending laterally across said box portion, said support being spaced from said arch portion;

a rod being coupled to and extending upwardly from said support;

a plurality of tubes, each of said tubes being coupled to and extending downwardly from said box portion, each of said tubes being aligned with a respective one of four corners of said box portion;

a pair of rails, each of said rails having a pair of stems each extending upwardly therefrom, each of said tubes insertably receiving a respective one of said stems on a respective one of said rails wherein each of said rails is configured to slide along the training field, each of said stems having a plurality of apertures therein being vertically distributed thereon; and a plurality of pins, each of said pins being extendable through a respective one of said tubes, each of said pins engaging a selected one of said apertures in said respective stem that is positioned in said respective tube such that sled is positioned at a selectable height on said rails;

a cushion being removably positioned on said sled wherein said cushion is configured to be pushed against by the youth during training, said cushion having a bottom side and a front side, said bottom side having a well extending upwardly therein, said arch portion of said frame extending upwardly in said well when said cushion is positioned on said sled having said front side being exposed wherein said front side is configured to be pushed against by the youth; and a plurality of weights, each of said weights being selectively positioned on said sled for increasing a weight of said sled wherein said sled is configured to pose increased resistance to the youth during training, each of said weights having an aperture extending therethrough, said rod extending through said aperture in each of said weights when each of said weights is positioned on said sled.

* * * * *